United States Patent [19]

Belanger

[11] 4,068,823

[45] Jan. 17, 1978

[54] APPARATUS FOR LIFTING THE BOLSTER OF A RAILWAY CAR TRUCK

[75] Inventor: Gerard Belanger, Boucherville, Canada

[73] Assignee: Tecnobec, Inc., Canada

[21] Appl. No.: 758,336

[22] Filed: Jan. 10, 1977

[30] Foreign Application Priority Data

Jan. 30, 1976 Canada ..... 245046

[51] Int. Cl. ..... B66f 7/26

[52] U.S. Cl. ..... 254/89 H

[58] Field of Search ..... 254/32–34, 254/89 H, 89 R

[56] References Cited

U.S. PATENT DOCUMENTS

| | | | |
|---|---|---|---|
| 2,636,715 | 4/1953 | Griffin | 254/89 H |
| 2,724,572 | 11/1955 | Weinberg | 254/89 H |

*Primary Examiner*—Robert C. Watson

*Attorney, Agent, or Firm*—Cushman, Darby & Cushman

[57] ABSTRACT

The apparatus comprises: an elongate rigid member of sufficient length so as to sit transversely on a pair of rails; a pair of spaced hydraulic jacks fixedly mounted to the rigid member and each provided at its head portion with a fitting element adapted to engage the under portion of the bolster of a railway car truck; and hydraulic conduits connecting the jacks to an external power source; the apparatus is inserted sidewise between the wheels of the car truck and, once positioned on the rails, it is manually rotated at one end to bring the jacks in vertical alignment with the bolster; the power source is energized to exert a lifting pressure on the bolster so as to free the suspension springs of the car truck from the weight of the car.

9 Claims, 4 Drawing Figures

APPARATUS FOR LIFTING THE BOLSTER OF A RAILWAY CAR TRUCK

FIELD OF THE INVENTION

The present invention relates generally to a lifting apparatus which is adapted to engage the bolster of a railway car truck for removing the weight of the car from some of the other parts of the truck.

BACKGROUND OF THE INVENTION

Quite frequent, a railway car must be jacked so that those damaged coil springs of the car truck suspension may be replaced or repaired. At the same time, this lifting operation allows an inspection of the axle bearings and/or re-packing and reviewing of journal biasses. The present method of lifting the bolster of a freight car consists in sliding a steel bar inside the bolster with one end extending outside sufficiently so that it may be used as a bearing point for the head of a ratchet lever jack, by means of which the bolster is lifted. If the freight car is loaded, one or more additional jacks of higher capacity (such as air power jacks) must be used to lift the load. This is required because the ratchet lever jack is of insufficient capacity to lift alone the load of the car; furthermore, the lever action of the steel bar on the bolster damages it and the load on the opposite side of the bolster tilts the truck. On occasion, the steel bar inserted in the bolster bends the upper wall of the bolster thereby reducing the clearance and rendering impossible removal and replacement of damaged coil springs. Furthermore, such method represents a safety hazard as a result of the foot of the lever jack laying either on ballasts or on the edge of a track tie in an unstable condition. Also, lifting a loaded car with air powered jacks is a long and laborious operation and can only be carried out at repair centers equipped with compressed air units.

STATEMENT OF THE INVENTION

It is an object of the present invention to provide a simple lifting apparatus which overcomes the above described disadvantages associated with railway car truck repairs.

A further object of the present invention is to provide an hydraulic lifting apparatus which is compact enough to be slid between the truck wheels so as to sit transversely on the rails and where the bearing points for the jacking operation are the rails themselves.

It is another object of the present invention to provide a lightweight hydraulic apparatus which can be operated on location by a manual, electric or air operated pump.

The present invention therefore relates to an apparatus for lifting the bolster of a railway car truck mounted on rails so as to remove the weight of said car from other parts of the truck, comprising: an elongate rigid member having sufficient length so as to sit transversely on both rails; a pair of hydraulic jacks each having a lower portion thereof fixedly secured to the rigid member, the jacks being spaced from one another on said rigid member a distance corresponding generally to the distance separating the rails; fitting means mounted at the upper portion of each jack for engaging the bolster; conduit means mounted to the rigid member for hydraulically connecting the jacks to an external power source; means on the rigid member allowing the rigid member to be rotated about an axis parallel to its longitudinal axis whereby, after the portion of the rigid member containing the jacks is inserted sidewise beneath the bolster to lay on the rails with the jacks extending in a plane substantial parallel with the plane of the rails, the rigid member may be rotated to bring the jacks in vertical alignment with the bolster for jacking engagement therewith.

In one form of the invention, the heads of the jacks are fixedly connected to the elongate member to prevent rotation of the heads relative to the axis of the jacks.

In another form of the invention, a rigid cross member connects the heads of the two jacks.

In another form of the invention, the heads are interconnected by means of a third jack.

Other objects and further scope of applicability of the present invention will become apparent from the detailed description given herein after; it should be understood, however, that the detailed description, while indicating preferred embodiment of the invention, is given by way of illustration only, since various changes and modifications within the spirit and scope of the invention will become apparent to those skilled in the art from this detailed description.

DESCRIPTION OF PREFERRED EMBODIMENT

Figure 1:
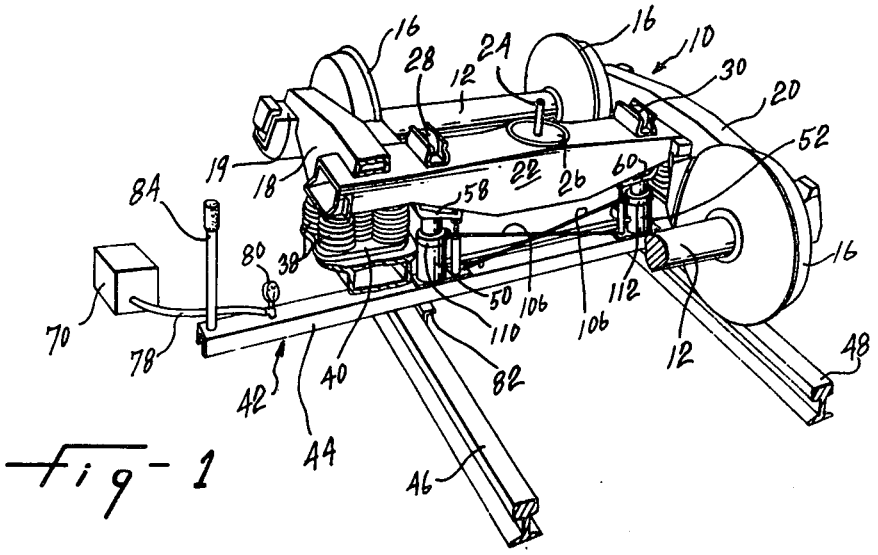
FIG. 1 is a fragmentary perspective view of a railway freight car truck mounted on rails illustrating a first embodiment of a lifting apparatus made in accordance with the present invention.

Referring to FIG. 1 of the drawings, there is shown part of a truck 10 of a railway car, and more particularly, of a railway freight car (not shown). Truck 10 consists of a pair of axles 12, each carrying a pair of wheels 16. Truck 10 further includes two side frames 18 and 20, each having its opposite ends resting on the axle bearings, generally denoted as 19. Extending transversely and centrally of the truck, a bolster 22 carries a center pin 24 mounted a center rotating plate 26 disposed centrally between two side bearings 28 and 30.

Figure 2:
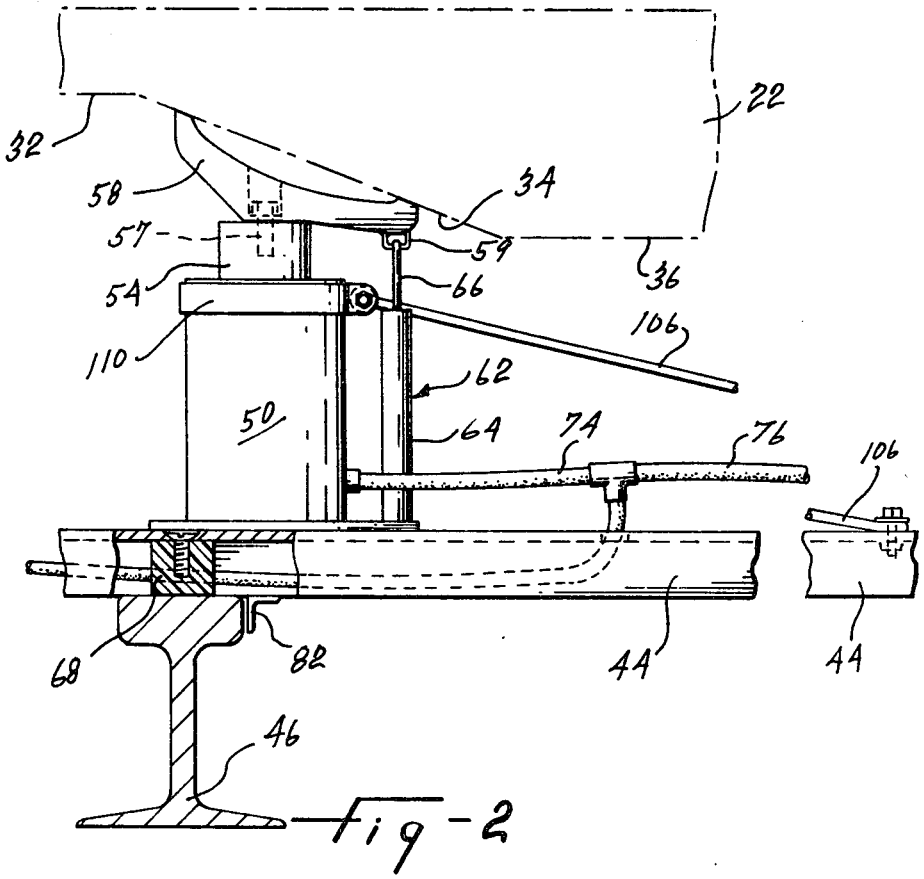
FIG. 2 is an enlarged elevational, partly broken, view showing the lifting apparatus mounted on a rail and engaging one side of a truck bolster.

The undersurface of bolster 22 includes two opposite end faces 32, two inclined faces 34 and a central substantially horizontal portion 36 (see FIG. 2). End faces 32 of the bolster bear against a plurality of coil springs 38 resting on an enlarged flat portion 40 provided centrally on each side frame 18, 20. This structure provides the suspension for the railway car. These coil springs are often damaged and must be replaced.

The present invention provides a compact lifting apparatus which enables quick and easy removal of damaged coil springs.

Referring to FIGS. 1 and 2, the lifting apparatus 42 of the present invention comprises a rigid elongated member 44, preferably of inverted U-shape configuration to provide lightness. The rigid member must be of sufficient length so as to lie transversely on both rails 46 and 48 on which the truck is mounted. A pair of hydraulic jacks 50 and 52 are fixedly mounted at their lower portion to the top face of member 44. These jacks are preferably spaced from one another a distance corresponding generally to the distance separating the two rails 46 and 48. However, referring more particularly to FIG. 2, jack 50 is shown slightly offset with respect to the vertical axis of rail 46; this is due to the particular configuration of side frame 18. However, jacks 50 and 52 must be as close as possible to the vertical plane of rail 46 since latter must act as a bearing point for the load of the car. Jacks 50 and 52 have their respective piston heads 54 and 56 provided with fitting members 58 and 60 which contact inclined faces 34 of bolster 22. As illustrated in FIG. 2, these fitting members are bolted to their respective piston heads. Although not shown in detail, the connection of the bolt 57 with members 58 should be such as to allow a slight rotation of members 58 in a vertical plane in order to fit varying configurations of bolster undersurfaces. However, to prevent the heads from rotating in a horizontal plane, there is provided a fixing member 62 having a lower cylindrical portion 64 fixed to the top face of elongate member 44, and a vertically movable upper portion 66 connected to the fitting member 58 by means of a U-bolt 59.

To reinforce the U-shaped channel member 44 on its bearing points on the rails, a pair of blocks (one of which is shown at 68) is inserted therein with the lower face thereof contacting the rails.

Jacks 50 and 52 are hydraulically connected to an external power source 70 by means of a series of conduits 72, 74, 76 and 78. A pressure gage 80 is also provided for measuring the pressure. Source 70 may be a manual pump, an electric pump with a.c. or d.c. motor or an air operated motor pump.

Two iron angles 82 fixedly mounted to the two sides of the U-shaped member 44 serve to accurately locate the lifting apparatus on the rails so that the jacks may be correctly positioned in vertical alignment beneath bolster 22.

At one end of the elongate member 44, there is provided some manual means whereby the elongate member may be rotated about an axis parallel to the longitudinal axis of channel member 44; these means may consist of a handle 84 which may be releasably mounted in openings at one end of the rigid member.

For security purposes, sway braces 106 may be provided to maintain the jacks in vertical alignment; they are connected, at one end, to their respective jack by means of a collar 110 and are bolted at the other end to the channel member 44.

In operation, the lifting apparatus of the present invention is brought or rolled (if provided with rollers) to the side of a railway car truck where it is rotated sidewise so that the two jacks are brought in a horizontal plane or in a plane substantially parallel to the plane including both rails 46 and 48. By means of handle 84, the apparatus is then pushed transversely between the truck wheels under a side frame 18, 20 until the two iron angles 82 are positioned so as to lie between the two rails. Then, the apparatus is rotated 90° and positioned so that the two jacks with their means 58 and 60 are in vertical alignment with the inclined faces 34 of the bolster. Then, source 70 is connected to the conduit system of the apparatus to cause the jacks to effect a lifting operation on the bolster whereby the car weight is removed from the suspension springs. Springs 38 can easily be removed from the side frames 18 and 20.

Figure 3:
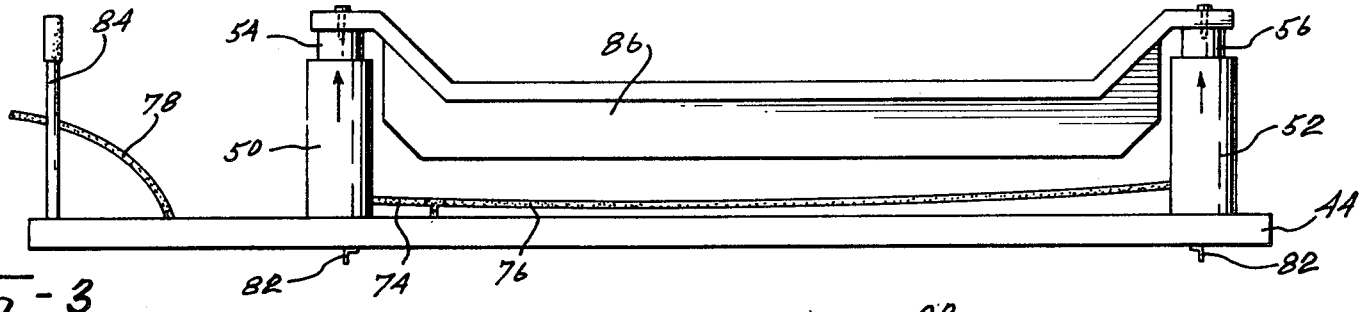
FIG. 3 is an elevational view showing a second embodiment of the lifting apparatus of the present invention.
Figure 4:
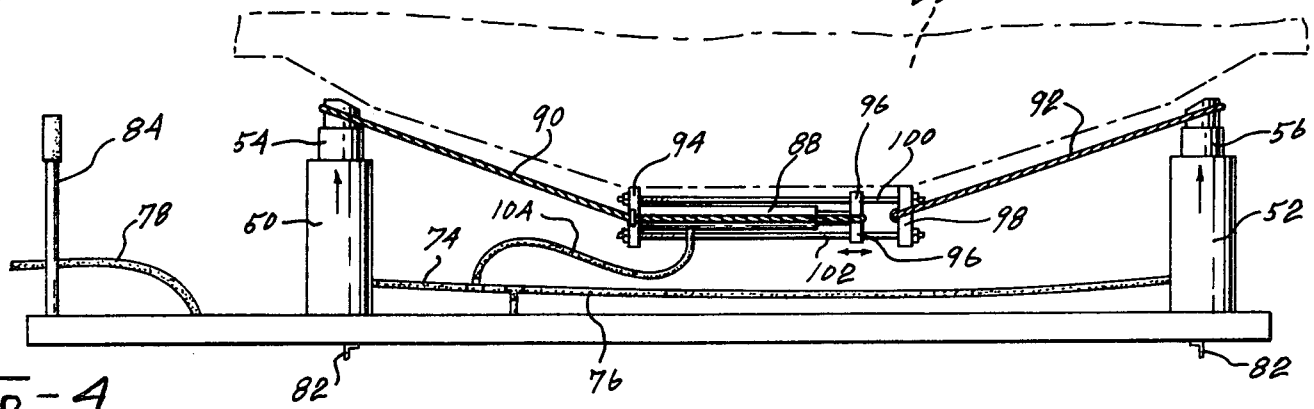
FIG. 4 is an elevational view showing a third embodiment of the lifting apparatus of the present invention.

Referring to FIGS. 3 and 4, there are shown other embodiments of the present invention wherein like reference numerals refer to corresponding parts of the apparatus shown in FIGS. 1 and 2.

In FIG. 3, the piston heads 54 and 56 of the jacks are interconnected by a rigid cross member 86 having a shape corresponding preferably to the underface of the bolster. This arrangement prevents the jacks to deviate from their vertical axis.

In FIG. 4, the piston heads of the jacks are interconnected by means of a third jack 88 and a pair of cables 90 and 92. Jack 88 has its cylinder portion fixedly mounted to a plate 94 and its piston head fixedly mounted to a second plate 96; a third plate 98 is secured to plate 94 by means of rods 100 and 102 bolted at their opposite ends. Plate 96 is adapted to slide relative to rods 100 and 102. Cable 90 joins the piston head 54 of jack 50 to the movable plate 96 while the piston head 56 of jack 52 is joined by cable 92 to the plate 98. An hydraulic conduit 104 interconnects the third jack to conduit 74 of the conduit system. In this embodiment, hydraulic pressure to the jacks 50 and 52 will also cause operation of jack 88. When the apparatus is positioned beneath the truck, jack 88 is in a retracted position and plates 94 and 98 are not in contact with bolster 22. When hydraulic pump 70 is operated, jack heads 54 and 56 are raised and contact the underneath portion of the bolster. Since a similar pressure is exerted on jack 88, the latter is also raised; plates 94 and 98 thereby come in contact with the under portion of the bolster thus preventing the heads of the jacks from spreading out during the lifting operation.

The following data is a typical example for lifting a freight car of 100 ton capacity loaded and unloaded:

a. unloaded car
   i. hydraulic pressure: 1000 psi
   ii. load per jack: 10,000 lbs.

loaded car
   i. hydraulic pressure: 9000 psi
   ii. load per jack: 60,000 lbs.

What is claimed is:

1. An apparatus for lifting the bolster of a railway car truck mounted on rails so as to remove the weight of said car from other parts of said truck, comprising: an elongate rigid member having sufficient length so as to sit transversely on both rails; a pair of hydraulic jacks each having a lower portion thereof fixedly secured to said rigid member, said jacks being spaced from one another on said rigid member a distance corresponding generally to the distance separating said rails; fitting means mounted at the upper portion of each said jack for engaging said bolster; conduit means mounted to said rigid member for hydraulically connecting said jacks to an external power source; means on said rigid member allowing said rigid member to be rotated about an axis parallel to its longitudinal axis whereby, after a portion of said rigid member containing both said jacks is inserted sidewise beneath said bolster to lay on both rails with said jacks extending in a plane substantially parallel with a plane that includes said rails, said rigid member may be rotated to bring said jacks in vertical alignment with said bolster for jacking engagement therewith.

2. An apparatus as defined in claim 1, wherein said means allowing said member to be rotated include a handle mounted at one end of said rigid member.

3. An apparatus as defined in claim 1, further comprising guide means fixedly mounted to said rigid member to accurately position said jacks on said rails.

4. An apparatus as defined in claim 1, further comprising fixing means fixedly mounted to said rigid member for preventing rotation of each said fitting means about the axis of said jacks.

5. An apparatus as defined in claim 1, further comprising transverse rigid means interconnecting each upper portion of said jacks for reinforcing said jacks during lifting operation.

6. An apparatus as defined in claim 1, further comprising a third jack disposed between said pair of jacks; cable means for connecting each end of said third jack to a corresponding upper portion of each said jack; and further comprising conduit means for hydraulically connecting said third jack to said conduit means of said pair of jacks for operation of said third jack.

7. An apparatus as defined in claim 1, wherein said rigid member is an inverted U-shaped channel element; said jacks being secured to the upper portion of said U-shaped element; said conduit means partially extending within said U-shaped element.

8. An apparatus as defined in claim 7, further comprising a pair of blocks each extending in said U-shaped element in an area corresponding to that portion of said rigid member sitting on said rails so as to reinforce said rigid member in said area; said blocks having openings therethrough for the passage of said conduit means therethrough.

9. An apparatus as defined in claim 1, further comprising pressure indicating means mounted on said elongated member and connected to said conduit means.

* * * * *